US006341909B1

(12) United States Patent
Fukui

(10) Patent No.: US 6,341,909 B1
(45) Date of Patent: Jan. 29, 2002

(54) RECORDING APPARATUS AND RECORDING-MEDIUM SUPPLY APPARATUS

(75) Inventor: Hiroshi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/469,612

(22) Filed: Dec. 22, 1999

(30) Foreign Application Priority Data

Dec. 25, 1998 (JP) ..... 10-371348

(51) Int. Cl.[7] ..... B41J 11/58; B41J 11/46
(52) U.S. Cl. ..... 400/629; 400/578; 400/582
(58) Field of Search ..... 400/629, 578, 400/582, 605; 399/382

(56) References Cited

U.S. PATENT DOCUMENTS 4,763,161 A * 8/1988 Forest et al. ..... 355/14
5,272,511 A * 12/1993 Conrad et al. ..... 355/325
5,481,353 A * 1/1996 Hicks et al. ..... 355/311
5,923,013 A * 7/1999 Suzuki et al. ..... 235/375

OTHER PUBLICATIONS

Mead Corporation, Research Disclosure #288020, Apr. 1988, pp. 1–3.*

* cited by examiner

*Primary Examiner*—John S. Hilten
*Assistant Examiner*—Charles H. Nolan, Jr.
(74) *Attorney, Agent, or Firm*—Fitzpatrick, Cella, Harper & Scinto

(57) ABSTRACT

A recording medium according to the present invention includes: a recording-medium supply mechanism; a single-sheet supply mechanism for supplying a recording medium S one sheet by another from a hold device to a conveyance path; and an overlap supply mechanism for supplying a desired number of sheets of a recording medium from the hold device in an overlapped state to the conveyance path. If there is one sheet or more of consecutive blank pages included in a recording medium to be supplied to the conveyance path, the recording apparatus overlaps and supplies a recording medium as many sheets as a value obtained by adding one to a number of the blank pages, to record recording data of a page immediately preceding or following the blank page.

12 Claims, 8 Drawing Sheets

RECORDING APPARATUS AND RECORDING-MEDIUM SUPPLY APPARATUS

This application is based on Japanese Patent Application No. 10-371348 (1998) filed Dec. 25, 1998, the content of which is incorporated hereinto by reference.

BACKGROUND OF THE INVENTION

1. Field of the Invention

The present invention relates to a recording apparatus and a recording-medium supply apparatus provided with an automatic sheet feeder (ASF) for supplying sheet automatically.

2. Description of the Related Art

Recorded data of a plurality of sheets transmitted to a recording apparatus may include a blank page having no data to be recorded. When such a blank page is included, a conventional recording apparatus would drive an ASF, a sheet-conveyance roller, etc., irrespective of whether a page in question is blank page or not, to perform a series of sheet conveying operations such as sheet supply, paper feed, and paper displacement, thus feeding out the blank page following a page on which a recording image is formed.

Therefore, the above-mentioned conventional recording apparatus requires, for a page on which no recording is performed, almost the same time and driving force as those required for a page on which recording is performed, thus leading to a problem of deteriorating a recording efficiency. This problem is remarkable particularly in the case where there is provided a plurality of blank pages.

SUMMARY OF THE INVENTION

In view of the above, it is an object of the present invention to provide a recording apparatus and a recording-medium supply apparatus capable of effectively supplying paper in the case where there is a blank page included in pages on which recording is to be performed, thus improving the overall efficiency of recording operations.

In the first aspect of the present invention, there is provided a recording apparatus having a conveyance path for a recording medium comprising:

means for conveying a recording medium along the conveyance path;

a hold means for holding a plurality of recording media; and recording-medium supply means for supplying a recording medium from the hold means to the conveyance path, wherein the recording-medium supply means supplies a recording medium in either mode selected based on recording data, of a single-sheet supply mode in which a recording medium held in the hold means is supplied one sheet by another to the conveyance path and an overlap supply mode in which a recording medium of a number of sheets obtained by adding one to a number of sheets of consecutive blank pages with no recording data is overlapped and supplied to the conveyance path.

Here, the recording-medium supply means may comprise:

a single-sheet supply mechanism for performing a single-sheet supply mode in which a recording medium held in the hold means is supplied one sheet by another to the conveyance path;

an overlap supply mechanism for performing an overlap/supply mode in which a recording medium as many sheets as a value obtained by adding one to a number of sheets of consecutive blank pages with no recording medium is overlapped and supplied to the conveyance path;

retrieval means for retrieving the recording data to retrieve a page number of a blank page with no recording data and also a number of sheets of consecutive blank pages;

setting means for setting a value obtained by adding one to a number of sheets of consecutive blank pages retrieved by the blank-page retrieval means, as a number of overlap sheets corresponding to a page number of a first blank page of the consecutive blank pages; and supply control means for selectively driving the overlap supply mechanism and the single-sheet supply mechanism, wherein the supply control means uses the overlap supply mechanism to overlap and supply a recording medium of a number of overlap sheets corresponding to the page number of head blank page if a recording medium to be supplied to a conveyance path corresponds to the page number of head blank page and, if a recording medium to be supplied to a conveyance path does not correspond to the page number of head blank page, uses the single-sheet supply mechanism to sequentially supply a single sheet of the recording medium; and a recording section for performing recording data to a recording medium records recording data of a page immediately following a blank page to an outermost recording medium of a plurality of overlapped recording medium.

The recording-medium supply means may comprise:

a single-sheet supply mechanism for performing a single-sheet mode in which a recording medium held in the hold means is supplied one sheet by another to a conveyance path;

an overlap supply mechanism for performing an overlap/supply mode in which a recording medium as many sheets as a value obtained by adding one to a number of sheets of consecutive blank pages with no recording medium is overlapped and supplied to the conveyance path;

retrieval means for retrieving the recording data to retrieve a page number of a blank page with no recording data and a number of sheets of consecutive blank pages;

setting means for setting a value obtained by adding one to a number of sheets of consecutive blank pages retrieved by the blank-page retrieval means as a number of overlap sheets corresponding to a page number of a start page of consecutive blank pages; and supply control means for selectively driving the overlap supply mechanism and the single-sheet mechanism, wherein the supply control means uses the overlap supply mechanism to overlap and supply a recording medium of a number of overlap sheets which is set corresponding to the page number of head blank page if a recording medium to be supplied to a conveyance path is a recording medium immediately preceding a recording medium corresponding to the page number of head blank page and, if a recording medium to be supplied to a conveyance path does not correspond to the page number of head blank page, uses the single-sheet supply mechanism to sequentially supply a single sheet of the recording medium; and a recording section for performing recording to a recording medium records recording data of a page immediately preceding a blank page to an outermost recording medium of a plurality of overlapped recording medium.

The conveyance path may be used to sequentially discharge the recording medium so that the recording medium may be overlapped with a recording face thereof facing upward.

The conveyance path may be used to sequentially discharge the recording medium so that the recording medium may be overlapped with a recording face thereof facing downward.

The overlap/supply mechanism may comprise:

a pressure application member provided so as to be movable both in a direction of supplying a recording medium and in a direction of laminating medium, with respect to a rear end of recording medium overlapped in a hold means;

supply/driving means for moving the pressure application member in the direction of supplying a recording medium; and pressure-application-position adjustment means for moving the pressure application means in the laminating direction;

wherein after an opposing position with respect to a rear end of a recording medium is adjusted by the pressure-application-position adjustment means, the supply/driving means is driven to permit a pressure application means to reciprocate in order to pressure a rear end of a plurality of recording media that oppose the pressure application member of recording media overlapped in a hold means, thus pushing out the plurality of recording media to the conveyance path.

The overlap/supply mechanism may comprise:

a pressure application member provided so as to be movable both in a direction of supplying a recording medium and in a direction of laminating a recording medium, with respect to a rear end of recording medium overlapped in a hold means;

supply/driving means for moving the pressure application member in the direction of supplying a recording medium; and pressure-application-position adjustment means for moving the pressure application means in the laminating direction;

wherein after an opposing position with respect to a rear end of a recording medium is adjusted by the pressure-application-position adjustment means, the supply/driving means is driven to permit a pressure application means to reciprocate in order to pressure a rear end of a plurality of recording media that oppose the pressure application member of recording media overlapped in a hold means, thus pushing out the plurality of recording media to the conveyance path.

The single-sheet supply mechanism may comprise: a supply roller separably provided to a recording medium placed at an outermost position of recording media overlapped in a hold means and supply-roller driving means for rotationally driving the supply roller; and by rotating the supply roller by use of the supply-roller driving means, a recording medium at an outermost place in contact with the supply roller is supplied and, when an overlap/supply mechanism is driven, and held in such a state as not to be prevented from moving in a direction of supplying the recording medium.

The supply roller may comprise on a peripheral surface thereof: a contact section which comes in contact with a recording medium; and a non-contact section which is separated from the recording medium, so that when an overlap/supply mechanism is driven, supply-roller-driving means stops rotation of a supply roller at such a phase that the non-contact section of the supply roller may oppose a recording medium.

The hold means may be box-shaped, to an inner surface of which is fixed a separating member with a high friction coefficient to be contacted with a front end of a recording medium in a supply-direction.

The conveyance means may be comprised of: a conveyance roller arranged in a conveyance path, and conveyance-roller driving means for rotationally driving the conveyance roller; and the conveyance-roller driving means rotates the conveyance roller by conveying to a recording position by a recording section a recording medium supplied by the recording-medium supply mechanism to a conveyance path, and in synchronization with movement in a main scanning direction by a recording section, conveys the recording medium in a sub-scanning direction which intersects with the main scanning direction.

The recording section may generate a bubble to ink by means of thermal energy to discharge ink by means of pressure of the bubble.

In the second aspect of the present invention, there is provided a recording-medium supply apparatus comprising:

a single-sheet supply mechanism for performing a single-sheet supply mode in which a recording medium held in a predetermined hold means is supplied one sheet by another to a conveyance path; and an overlap/supply mechanism for performing an overlap/supply mode in which a recording medium held in the hold means is supplied to a conveyance path in such a state as to be overlapped as many as a desired number of sheets.

The above and other objects, effects, features, and advantages of the present invention will become more apparent from the following description of embodiments thereof taken in conjunction with the accompanying drawings.

DETAILED DESCRIPTION OF THE PREFERRED EMBODIMENTS

The following will describe in detail the embodiments of the present invention with reference to drawings.

Figure 1:
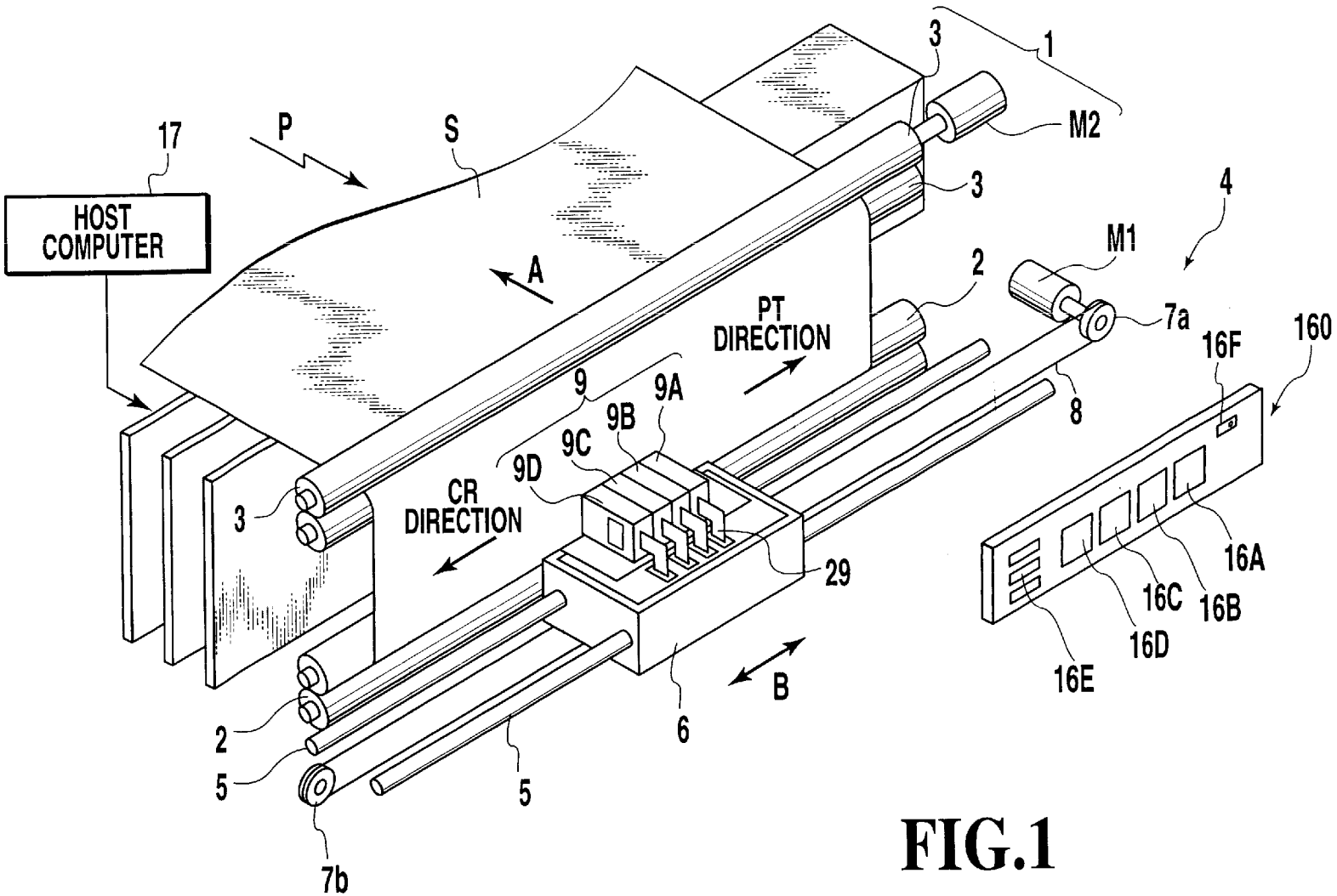
FIG. 1 is a perspective view illustrating a configuration around a carriage of a recording apparatus relating to an embodiment of the present invention.
Figure 2:
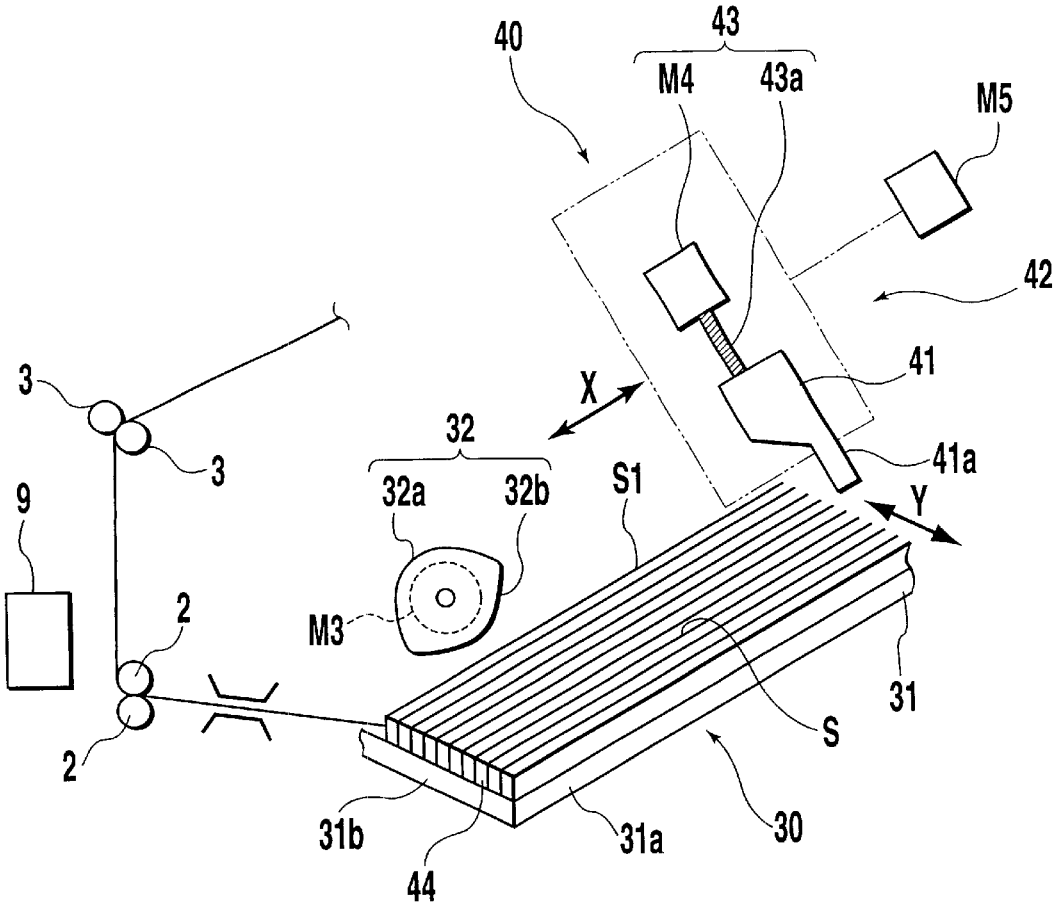
FIG. 2 is a perspective view illustrating am ASF apparatus etc. of the same embodiment as that of FIG. 1.

FIGS. 1 and 2 show configurations around a carriage of a recording apparatus according to an embodiment of the present invention, in which the recording apparatus is a color-ink-jet printer which employs so-called a bubble-jet system of generating bubbles by thermal energy emitted from an electro-thermal energy-converter so that the bubbles may apply pressure to discharge ink.

As shown in FIGS. 1 and 2, This recording apparatus comprises: an automatic recording-medium supply apparatus (ASF) 30 given as a single-sheet supply mechanism which constitutes part of a recording-medium supply mechanism for consecutively supplying a recording medium such a sheet or a plastic sheet; a recording-medium conveyance mechanism 1 for conveying medium in a sub-scanning direction (direction A); and a head moving mechanism 4 for moving a recording head given as a recording means in a main scanning direction, which are all attached integrally to a body which constitutes an outer frame of the recording apparatus. The recording-medium conveyance mechanism 1 is comprised of: a pair of conveyance rollers 2, 2 arranged in the main conveyance direction; a pair of conveyance rollers 3, 3 arranged above the conveyance rollers 2, 2; and a motor M2 for driving the conveyance rollers 3, 3, in such a configuration that the conveyance rollers 3, 3 and the conveyance rollers 2, 2 are linked by an interlocking mechanism such as an endless belt in such a way that the rollers 2, 2 and the rollers 3, 3 may rotate in mutual synchronization. Also, when a recording medium supplied from the ASF30 is received, the conveyance rollers 2, 2 is caused by a driving force of the motor 4 to guide the recording medium to the conveyance rollers 3, 3, from which the recording medium is moved in the sub-conveyance direction. Note here that at a recording position where recording is performed on a recording medium between the conveyance rollers 2, 2 and the conveyance rollers 3, 3 is arranged an ink-ejection unit of the recording head 9 in an opposing manner.

The head moving mechanism 4 comprises: two guide shafts 5, 5 for guiding the recording head 9 in the main conveyance direction; an endless wire 8 engaged over a motor pulley 7*a* and a driven pulley 7*b;* and a carriage motor (CR motor) M1 for rotating the motor pulley 7*a*. When the CR motor M1 is driven, the carriage 6 reciprocates via the wire 8 along the guide shafts 5, 5.

Also, the carriage 6 is detachably mounted with a recording head 9 as a recording means. The recording head 9 is intended for printing color images, comprising four recording heads (black head 9A, cyan head 9B, magenta head 9C, and yellow head 9D) corresponding to four colors of black (Bk), cyan (C), magenta (M), and yellow (Y). In front of each recording head, i.e. on a surface opposing the recording medium 1 is provided an ink-ejection unit which has a plurality of (e.g., 64 or 128) ink ejection nozzles arranged along a direction intersecting with the main scanning direction B. In this case, the ink-ejection nozzles are arranged in a vertical column.

Figure 4:
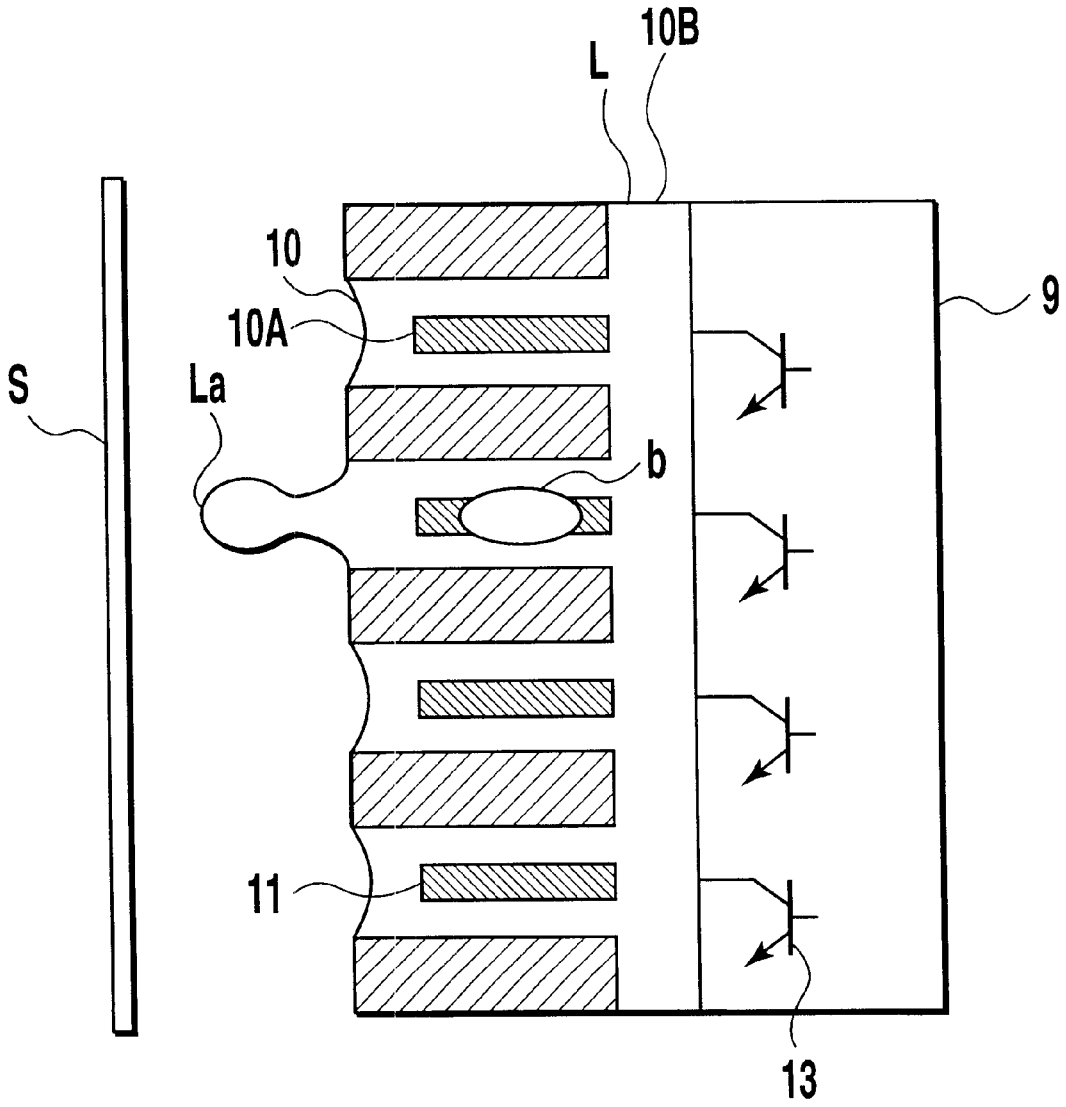
FIG. 4 is a vertical side view schematically illustrating a configuration of a head of the same embodiment of that of FIG. 1.

FIG. 4 schematically shows part of the ink-ejection unit of the recording head 9.

As shown in FIG. 4, on a surface opposing the recording head 9 is formed vertically a plurality of ink ejection nozzles 10 at a predetermined pitch, to drive an electro-thermal energy converter (e.g., exothermic resistor) 11 provided opposing thereto based on recording information, in order to give rise to a film-boiling phenomenon so as to generate a bubble b, pressure of which is used to discharge ink L in order to form a flying ink droplet La to stick it onto a recording medium S in a predetermined pattern, thus performing recording in a dot pattern.

The recording head 9 provides with a heat driver 13 to switch between make/break states of the electro-thermal energy converter 11, in such a configuration that a circuit board of a driver circuit 26 (see FIG. 3) for performing the above-mentioned driving operation by use of the heat driver 13 is provided to the carriage 6. Reference numerals 10A and 10B in FIG. 4 indicate a liquid path and a common liquid chamber respectively.

The ASF1, on the other hand, has such a configuration as shown in FIG. 2. That is, the ASF1 comprises a box-shaped cassette (hold means) 31 for holding sheet, above which a supply roller 32 for feeding out a recording medium S held inside is rotationally supported around an axis, which is actually rotated by a motor (not shown). When the supply apparatus rotates, part of an outer periphery (contact portion) is pressed, by the rotation, against an upper surface of the sheet, thus pushing out the recording media one sheet by another onto the side of the conveyance rollers 2, 2.

Also, on an outer periphery of the supply-path roller 32, a non-contact portion 32*b* is formed in addition to the contact portion 32. The portion 32 has such a size and a shape that the non-contact portion 32*b* may be spaced from the recording medium S at a position where it opposes the recording medium S. When a later-described overlap supply mechanism is operating, the non-contact portion comes against the recording medium S, not to prevent the recording medium S from being moved in a supply direction. A mode for conveying a sheet by use of the supply roller 32 is called a single-sheet supply mode.

Behind the cassette 31 is provided an overlap supply mechanism 40 which overlaps a desired number of sheets of recording medium Sa and sends out (overlaps and supplies) from the recording medium S contained in the cassette 31. The overlap supply mechanism 40 comprises: a pressure application member 41 provided roughly in parallel with a bottom surface 31*a* of the cassette 31 behind the cassette 31 and so as to reciprocate in a direction (supply direction) X in which it moves back and forth against the conveyance roller; a pressure application mechanism (supply/drive mechanism) 42 for moving the pressure application member 41 in the supply direction X; and an elevation mechanism (pressure-position adjustment/driving means) 43 for moving pressure application member 41 in laminating direction Y of the recording medium in the cassette 31.

The elevation mechanism 43 comprises a ball screw shaft 41*a* engaged with the pressure application member 41 and an elevation motor M4 for rotating the ball screw shaft 41*a,* in such a configuration that when the ball screw shaft 43*a* rotates, the pressure application member 41 is lifted and lowered. The pressure application mechanism 42 is comprised of an actuator M5 such as a motor or solenoid, so as to cause the elevation/driving mechanism 43 to reciprocate in the back-and-forth movement direction X. In FIG. 2, a reference numeral 41*a* indicates a claw protruding below the pressure application member 41 and a numeral 44 indicates a plate-shaped separate member sticking to an inner surface of a front wall of the cassette, made of a member such as rubber with a high friction coefficient.

In FIG. 1, a numeral 160 indicates an operation panel provided to an outer case constituting an outer frame of the present recording apparatus, on which are provided: an key-setting unit having an on-line/off-line switching key 16A for making and breaking a connection with a host computer 17, a line-feed key 16B, a sheet-feed key 16C, and a recording-mode switching key 16D; and a display unit having warning lamps such as a plurality of alarm lamps 16E and a power lamp 16F.

Figure 3:
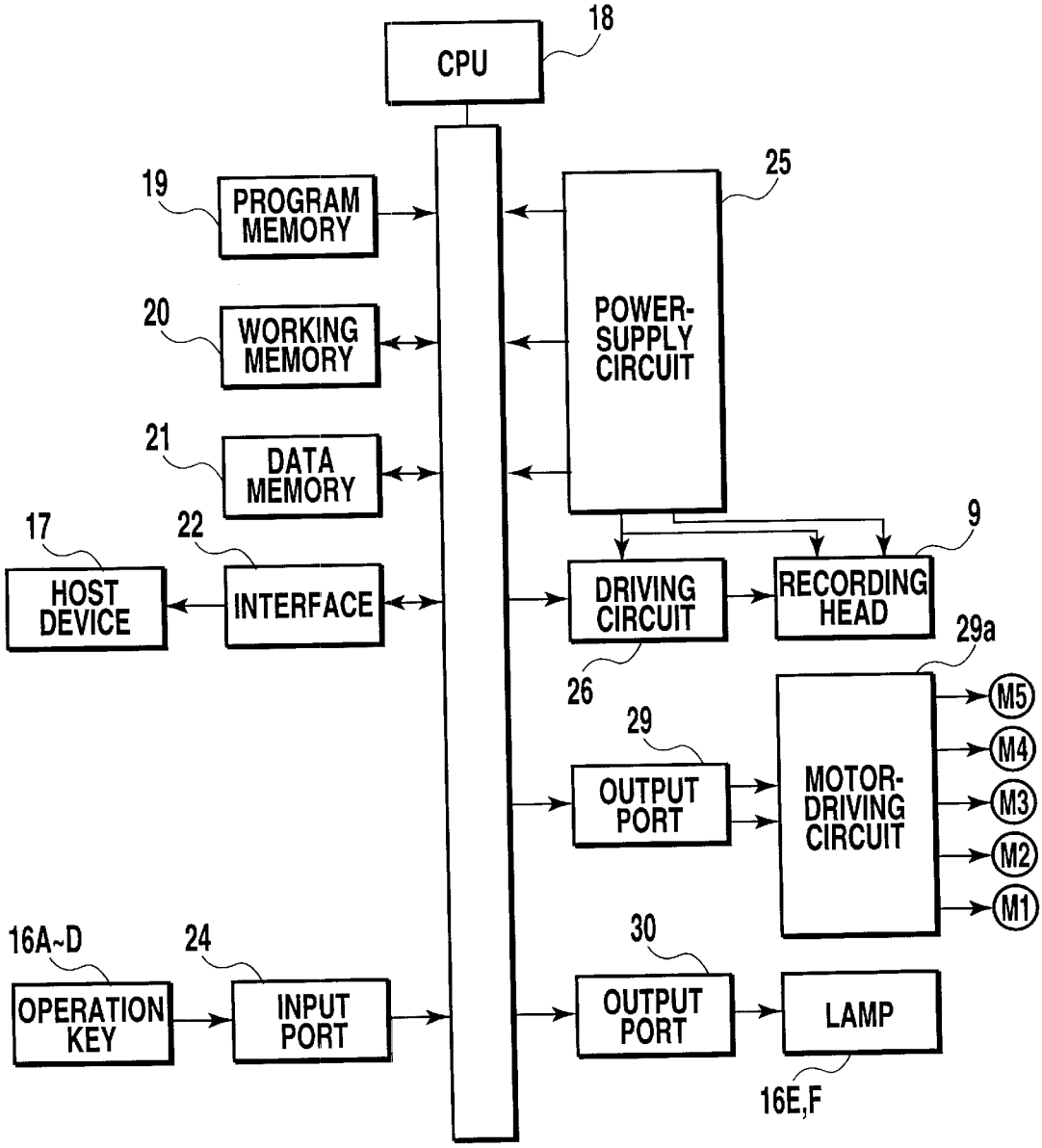
FIG. 3 is a block diagram illustrating a configuration of a control-system circuit of the same embodiment as that of FIG. 1.

FIG. 3 is a block diagram illustrating a control-system circuit of the recording apparatus in this embodiment of the present invention.

In FIG. 3, a numeral 18 indicates a CPU for performing predetermined arithmetic operations, counting, retrieval, decision, and control operations according to a program stored in a program memory 19, thereby functioning as decision means, blank-page retrieval means, number-of-overlapped-sheet counting means, and various control means. The CPU 18 is connected with a data memory 21 and a working memory 20 for storing data sent from the host computer etc.

Also, the CPU 18 is connected with a head-driving circuit and has its output port 29 connected with a motor-driving circuit 29*a* for driving the motors M1–M6 and its output port 30 connected with a light-emitting element serving as a light source for the display units 16E and 16F. Also, the CPU 18 has its input port 24 connected with various operation keys 16A–16D on the operation panel 160. A numeral 25 indicates a power-supply circuit for supplying power to various units including the head 9 and the driving circuit 26.

Next, operations of a recording apparatus having the above-mentioned configuration are described with reference to flowcharts shown in FIGS. 5 and 8.

Figure 5:
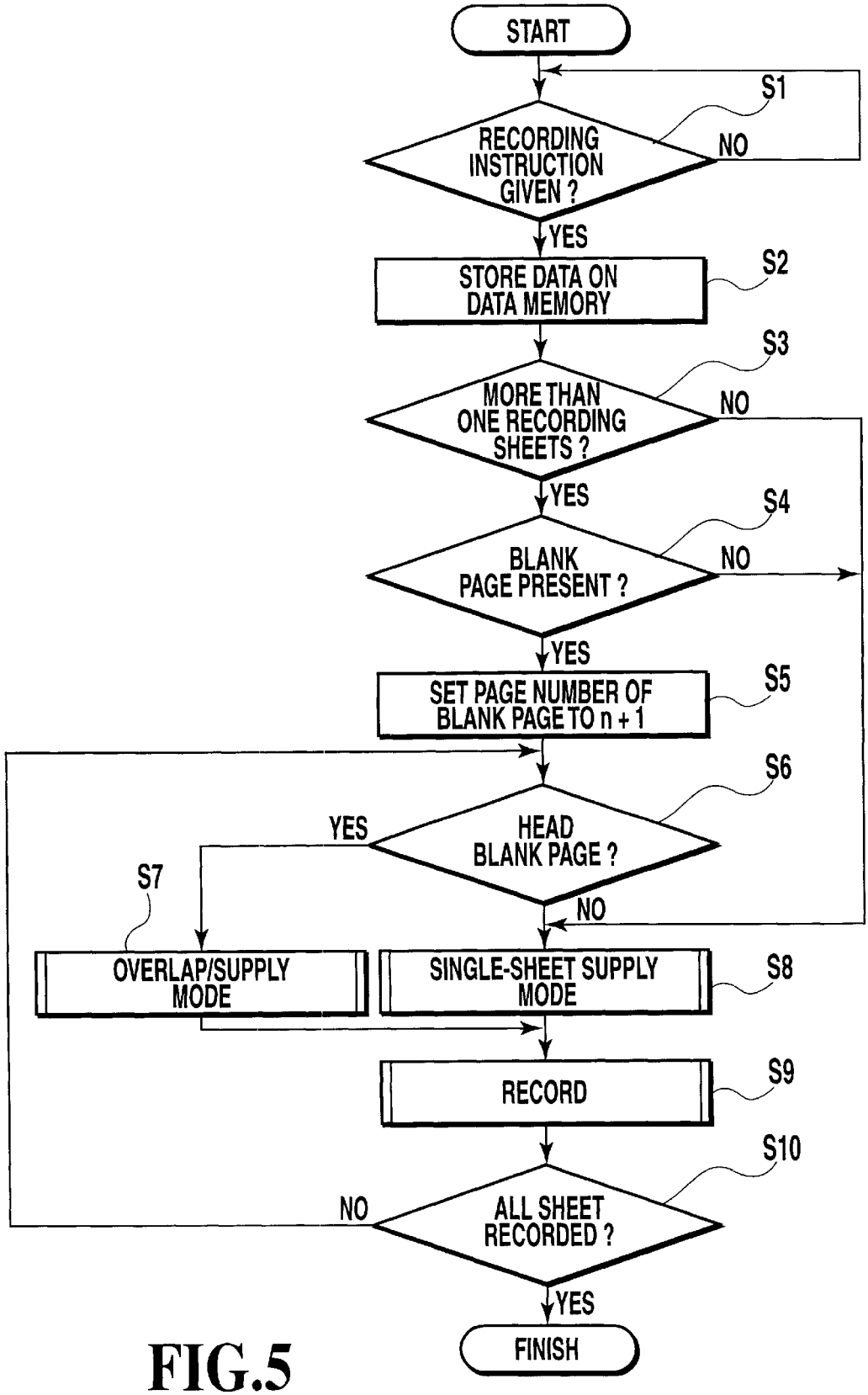
FIG. 5 is a flowchart showing an overall operational procedure of the same embodiment as that of FIG. 1.

The CPU 18 supervises reception of data sent from the host computer 17 via an interface 22, thus performing the following operations according to a flowchart shown in FIG. 5.

Figure 7:
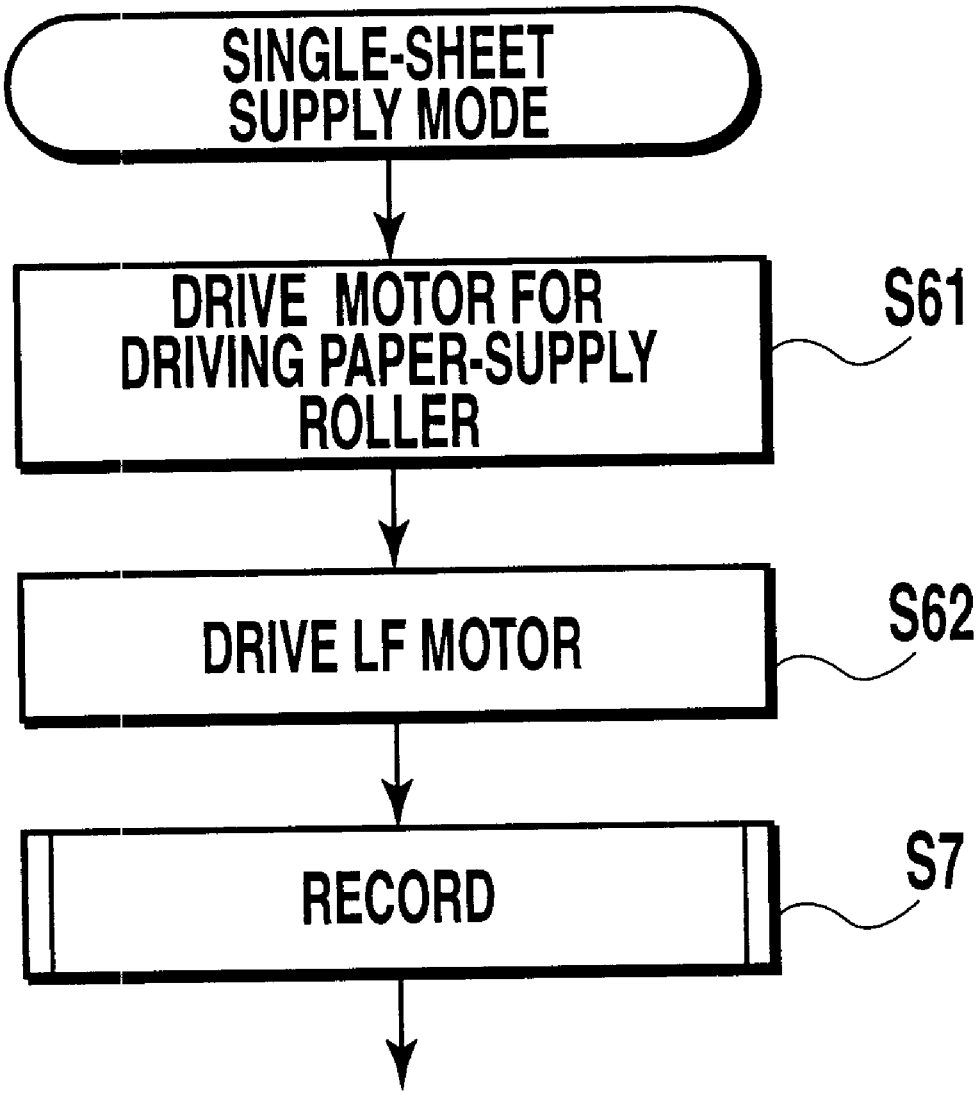
FIG. 7 is a flowchart showing operations in a single-sheet supply mode of the same embodiment as that of FIG. 1.

That is, the CPU 18 decides whether a recording instruction is sent from the host computer (step 1) and, if an instruction signal demanding a signal reception and recording operation is sent, stores once thus sent data in the data memory 21 (step 2) and then, retrieves data stored in the data memory to decide whether the number of sheets to be recorded is one or more (step 3). If it is one, the CPU 18 goes to step 8 to perform a single-sheet supply mode shown in FIG. 7 in order to feed out a single sheet of sheet to a recording region and then performs a later-mentioned recording operation (step 9) and finishes its processing immediately following the recording data is all recorded (step 10).

Now, supply operations for the recording medium S in the single-sheet supply mode are described.

In the single-sheet supply mode, the CPU 18 controls the motor driving circuit 29*a* to drive the motor M1 so as to rotate the supply roller 32 (step 61). With this, the supply roller 32 rotates while being pressured against a recording medium overlapped in a cassette, thus applying pressure to the recording medium toward the roller, whereupon the recording medium S is pressured against a separating member 44 and thumbed, so that only a recording medium S positioned at a top is pushed forward and fed to the conveyance rollers 2, 2. Then, when a front end of the recording medium reaches the conveyance rollers 2, 2, the motor driving circuit 29*a* is controlled to drive the LF motor M2, thus supplying a single sheet of paper (step 62).

Figure 6:
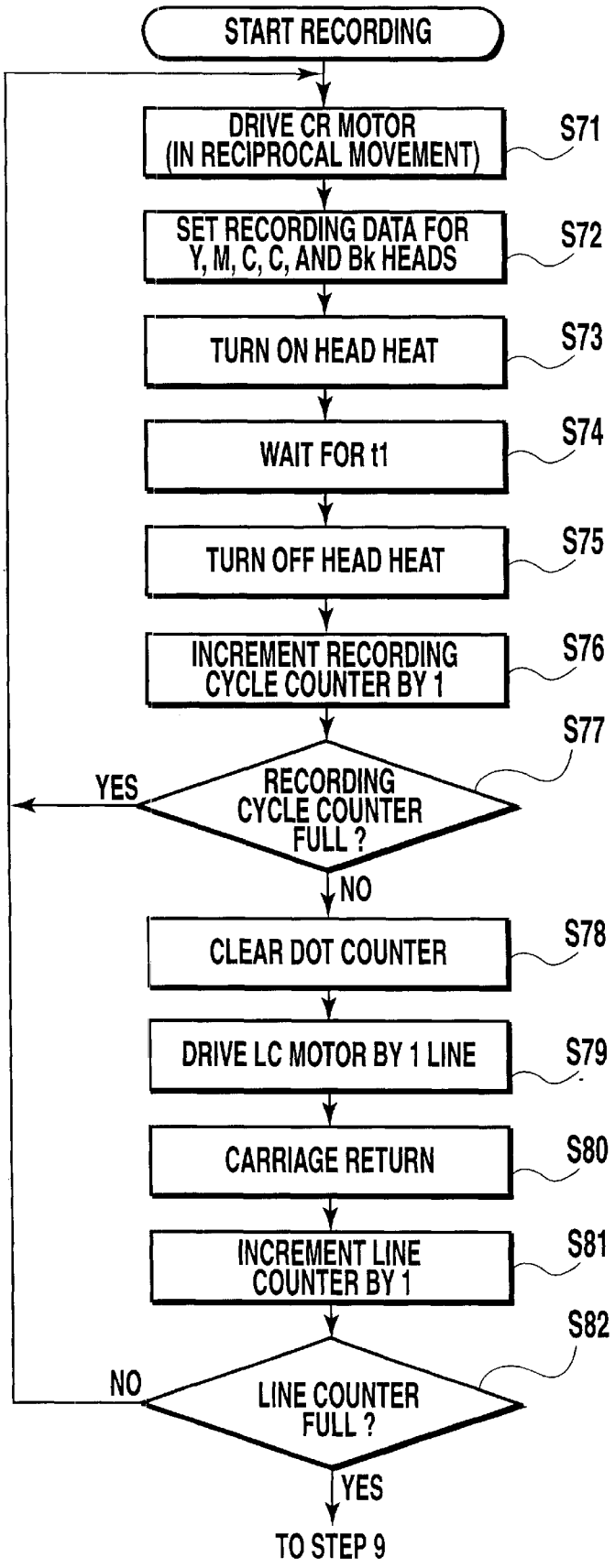
FIG. 6 is a flowchart showing recording operations of the same embodiment as that of FIG. 1.

Recording operations, on the other hand, are performed according to a flowchart shown in FIG. 6. The following will describe single-direction printing operations by which recording is performed only in a forward direction (PT direction shown in FIG. 1).

In recording, the CPU 18 first operates the motor driving circuit 29*a* from the output port 29 to drive the CR motor M1 in a positive direction to start forward movement of the carriage 6 placed at a home position. At the same time, the CPU 18 operates the driving circuit 26 to supply a specified heating pulse to the head 9 to heat the electro-thermal energy converter 11 in the head 9 to generate a bubble to ink so that its pressure may discharge ink from the ink discharging nozzle 10, thus performing 1-dot recording operations. A width of the heating pulse, i.e. a waiting time t1 from a start of heating the electro-thermal energy converter 11 to a stop of heating is measured by a timer provided hardware-wise or software-wise.

Thus, each time 1-dot recording operations are performed, a dot counter provided to the working memory 20 counts up by one (step 76). The CPU decides whether a count value has reached a specified number of dots to be formed within one reciprocating period (one scanning period) of the head 9, that is, whether a recording cycle counter is full (step 77) and, if it has not reached yet, returns to step 71 to repeat operations of steps 71 through 76. If it decides at step 77 that the dot counter count value has reached that specified number of dots, the CPU 18 clears the dot counter count value (step 78). The CPU further drives the LF motor M2 via the motor driving circuit 29*a* to feed the recording medium S in a main scanning direction by one line and then drives the CR motor M1 via the motor driving circuit 29*a* to return the carriage to its home position (carriage return). Afterward, each time one line of recording is performed, a line counter provided to the working memory 20 increments its count value by one (step 81), so that operations of step 71 through 82 are repeated until the count value reaches a predetermined number of lines, whereupon the recording is finished.

At step 3 shown in FIG. 5, on the other hand, in the case where the number of sheets of the recording medium S to be recorded is decided to be two or more, the CPU 18 decides whether there is present a page having no data to record, i.e., a blank page included in the recording medium (step 4) and, if there is no such a page present, goes to step 8 to perform operations of steps 8 through 10 and finish recording operations when recording is completed on all sheet (step 10). Here, decision for presence of a blank page at step 4 is made by retrieving the data memory 21.

At step 4, in the case where it is decided that there is present a blank page, data recorded in the data memory 21 is retrieved as mentioned above (step 4) to set the page number of the blank page of the recorded data and also the number of consecutive sheet of the blank pages (n) and add 1 to a value of n to calculate a value (n+1) and set the value (n+1) corresponding to the first blank page number of these consecutive blank pages(step 5).

A first blank here refers to the number of a blank page first supplied of the consecutive blank pages and, if for example pages 3–5 and 11–13 are blank, page 3 and 11 are first blank pages, so that the first blank page number is "3" and "11."

Figure 8:
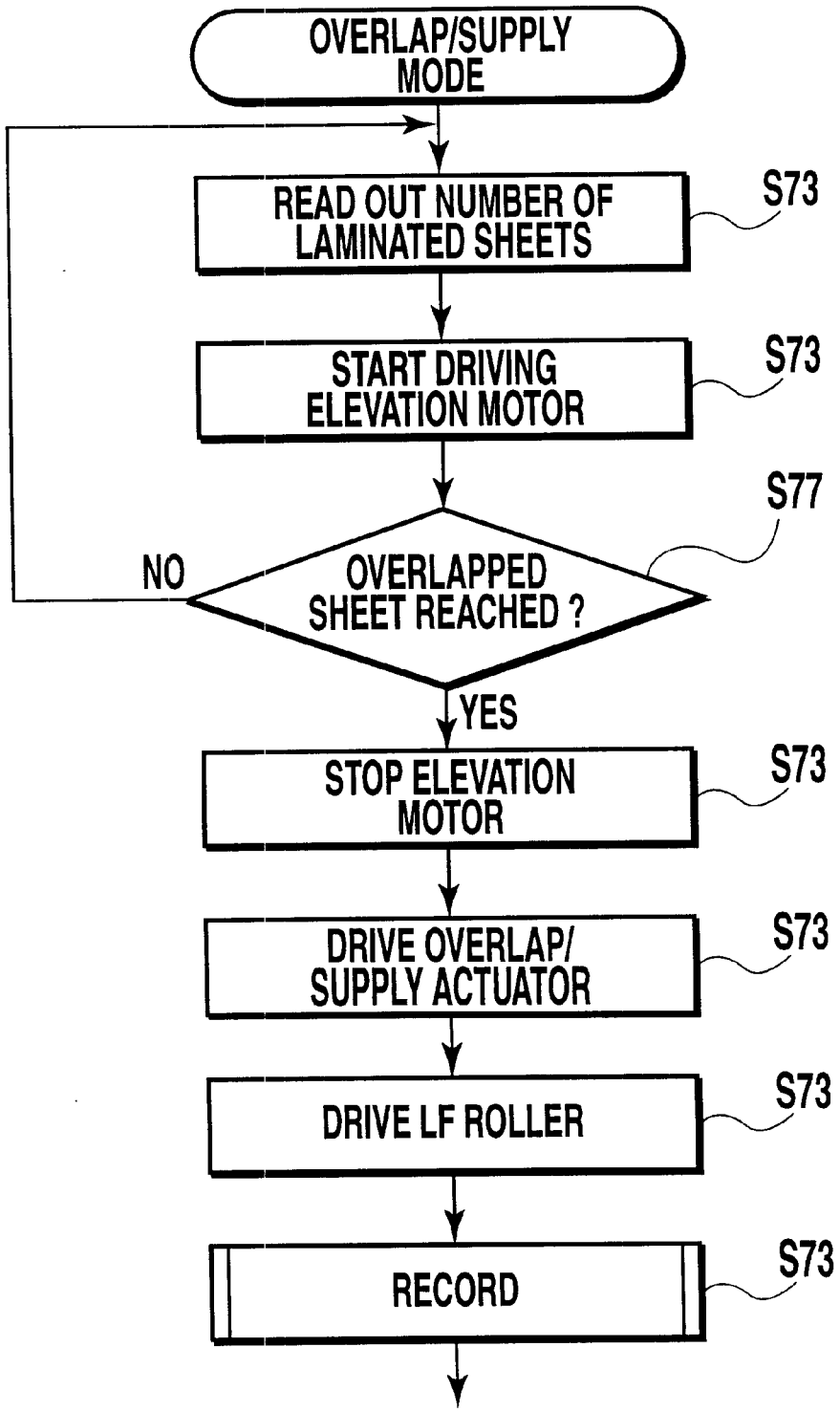
FIG. 8 is a flowchart showing operations in an overlap supply mode of the same embodiment as that of FIG. 1.

Then, the CPU 18 decides whether the page number of the recording medium S to be fed to the recording head currently agrees with a preset page number of a first blank page and, if they agree, selects an overlap/supply mode to perform overlap/supply operations shown in FIG. 8.

In the overlap/supply mode, the CPU 18 reads out a number of overlap sheets (n41) which number is set corresponding to the first blank page number (step 51) and, according to a value of the number of overlap sheet, starts driving the elevation motor M4 via the motor driving circuit 29*a* to rotate the ball screw shaft 43*a*, thus lifting or lowering the pressure application member 41 (step 52). Behind the overlapped recording medium S, when the claw 41*a* of the pressure application member 41 protrudes downward from an upper surface of the highest recording medium S1 by as much as the number of overlap sheets, the CPU 18 stops driving the elevation motor M4 (steps 53, 54).

The CPU 18 then drives the overlap/driving actuator M5 via the motor driving circuit 29*a* (step 55) to operate the pressure application mechanism 42, thus moving the whole elevation mechanism 43 including the pressure application mechanism 41 in the overlap-feeding direction Y of the recording medium S. With this, the claw 41*a* of the pressure application member 41 presses only a rear end of the highest (n+1) sheet of the recording medium S. As a result, the plurality of sheets of the recording medium S thus pressed by the claw 41*a* is pressured against the separating member 44 at its front end and separated from the other sheets of the recording medium S and fed from the cassette in the supply direction X.

When the front end of the recording medium S reaches the conveyance rollers 2, 2, the CPU 18, based on a detection signal sent from a sensor (not shown), stops the actuator M5 of the pressure application/driving mechanism 42 and performs reverse driving operations sequentially to lift the elevation mechanism 43 in the Y direction back to its initial position and, at the same time, drives the LF motor M2 to rotate the conveyance rollers 2, 2, thus moving the recording medium S to a recording-start position (step 56). Then, based on recording data sent from the host computer 17, the CPU 18 performs the recording operations to record data only on one sheet of a recording medium S, of overlapped recording medium S, which is at the outermost position opposing the recording head, thus discharging the remaining overlapped recording medium S as a blank page. Then, the CPU 18 repeat the operations of steps 6–10 until the all sheet of the recording medium S is discharged, whereupon the recording operations are finished. With this, there is provided such a state of the paper-ejection unit that a blank page is appropriately inserted into the recording pages to which recording data is recorded, thus obtaining a desired overlap state.

In this embodiment, a conveyance path is formed from the cassette 31 to the paper ejection unit, so that a recording medium is sequentially overlapped with its recording surface facing upward. Therefore, if for example pages 3–5 of recording data are blank, the recording medium of pages 1 and 2 is sequentially overlapped with the recording surface facing upward and then the blank pages 3–5 as well as page 6 are conveyed an overlapped manner and are overlapped on the recording surface of page 2 with their recording surface facing upward. As a result, between pages 2 and 6, thee sheets of a blank page are inserted, thus obtaining a preset overlap state.

Although in this embodiment, a recording medium is overlapped with its recording surface facing upward, so that when a fist page is detected at step 6, an overlap/supply operation is started, when on the other hand such a conveyance path is used that a recording medium is overlapped with its recording surface facing downward, an overlap/supply operation may be performed when a page immediately preceding a first blank page is supplied, thus inserting a blank page at an appropriate position.

The present invention may also be applied not only to an ink-jet type recording apparatus but also to a thermal transfer type or other recording type of recording apparatus and also to such a system, among ink-jet systems that, other than a so-called bubble-jet system of, as mentioned in the above embodiment, generating a bubble to ink by thermal energy to use its pressure in order to discharge ink, that uses a piezoelectric element in a flow path of ink at the ink head to use its driving force in order to discharge ink.

Such a bubble-jet system, moreover, can change an ink state by thermal energy from an electro-thermal energy converter or a laser beam, thus giving excellent effects to a recording apparatus. That is, such a system can achieve high-density, highly-fine recording.

Although the above embodiment has been described in a case where a recording-medium supply apparatus is integrally mounted to the body of a recording apparatus, the recording-medium supply apparatus may be detachably mounted to the body of the recording apparatus so as to be attached to the recording apparatus as required. For example, it may be thought of that a single-sheet supply mechanism and an overlap supply mechanism having the same configuration as that of the above embodiment are mounted to a support body other than the body of the recording apparatus in such a way that a hold means of a recording medium can be fixedly or detachably mounted to the support body.

As described above, in the above embodiment, when one or a plurality of consecutive blank pages is included in a recording medium to be supplied to a recording section, one sheet of recording medium is added to the blank page and overlapped and supplied to record recording data of a page immediately preceding or following the blank page, to avoid waste in time and energy in contrast to the conventional system of conveying blank pages only, thus achieving effective supply of recording medium and, at the same time, enabling consecutive recording irrespective of whether there is a blank page present or not, to largely improve recording efficiency.

Also, such a configuration can be provided that by rotating a supply roller against an outermost recording medium of recording media overlapped in a hold means to supply a single sheet of the recording medium and, at the same time, by not restricting a movement, in a supply direction, of the recording medium when the overlap/supply mechanism is being driven, the recording medium can be smoothly supplied without a supply operation by the overlap/supply mechanism being prevented by the single-sheet supply mechanism.

If in particular on the outer periphery of the supply roller are formed a contact section which contacts a recording medium and a non-contact section, a recording-medium supply operation can be performed by contacting the contact section and the recording medium and, when the overlap/supply mechanism is activated on the other hand, only by very simply opposing the non-contact section against the recording medium, the recording medium is prevented from being overlapped, resulting in a simple and inexpensive configuration.

The present invention has been described on detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus having a conveyance path for a recording medium comprising:

means for conveying a recording medium along said conveyance path;

a hold means for holding a plurality of recording media; and recording-medium supply means for supplying a recording medium from said hold means to said conveyance path, wherein said recording-medium supply means supplies a recording medium in either mode selected based on recording data, of a single-sheet supply mode in which a recording medium held in said hold means is supplied one sheet by another to said conveyance path and an overlap supply mode in which a recording medium of a number of sheets obtained by adding one to a number of sheets of consecutive blank pages with no recording data is overlapped and supplied to said conveyance path.

2. The recording apparatus as claimed in claim 1, wherein said recording-medium supply means comprises:

a single-sheet supply mechanism for performing a single-sheet supply mode in which a recording medium held in said hold means is supplied one sheet by another to said conveyance path;

an overlap supply mechanism for performing an overlap/supply mode in which a recording medium as many sheets as a value obtained by adding one to a number of sheets of consecutive blank pages with no recording medium is overlapped and supplied to said conveyance path;

retrieval means for retrieving said recording data to retrieve a page number of a blank page with no recording data and also a number of sheets of consecutive blank pages;

setting means for setting a value obtained by adding one to a number of sheets of consecutive blank pages retrieved by said blank-page retrieval means, as a number of overlap sheets corresponding to a page number of a first blank page of said consecutive blank pages; and supply control means for selectively driving said overlap supply mechanism and said single-sheet supply mechanism, wherein said supply control means uses said overlap supply mechanism to overlap and supply a recording medium of a number of overlap sheets corresponding to said page number of head blank page if a recording medium to be supplied to a conveyance path corresponds to said page number of head blank page and, if a recording medium to be supplied to a conveyance path does not correspond to said page number of head blank page, uses said single-sheet supply mechanism to sequentially supply a single sheet of said recording medium; and a recording section for performing recording data to a recording medium records recording data of a page immediately following a blank page to an outermost recording medium of a plurality of overlapped recording medium.

3. The recording apparatus as claimed in claim 1, wherein said recording-medium supply means comprises:

a single-sheet supply mechanism for performing a single-sheet mode in which a recording medium held in said hold means is supplied one sheet by another to a conveyance path;

an overlap supply mechanism for performing an overlap/supply mode in which a recording medium as many sheets as a value obtained by adding one to a number of sheets of consecutive blank pages with no recording medium is overlapped and supplied to said conveyance path;

retrieval means for retrieving said recording data to retrieve a page number of a blank page with no recording data and a number of sheets of consecutive blank pages;

setting means for setting a value obtained by adding one to a number of sheets of consecutive blank pages retrieved by said blank-page retrieval means as a number of overlap sheets corresponding to a page number of a start page of consecutive blank pages; and supply control means for selectively driving said overlap supply mechanism and said single-sheet mechanism, wherein said supply control means uses said overlap supply mechanism to overlap and supply a recording medium of a number of overlap sheets which is set corresponding to said page number of head blank page if a recording medium to be supplied to a conveyance path is a recording medium immediately preceding a recording medium corresponding to said page number of head blank page and, if a recording medium to be supplied to a conveyance path does not correspond to said page number of head blank page, uses said single-sheet supply mechanism to sequentially supply a single sheet of said recording medium; and a recording section for performing recording to a recording medium records recording data of a page immediately preceding a blank page to an outermost recording medium of a plurality of overlapped recording medium.

4. The recording apparatus as claimed in claim 1, wherein said conveyance path is used to sequentially discharge said recording medium so that said recording medium may be overlapped with a recording face thereof facing upward.

5. The recording apparatus as claimed in claim 1, wherein said conveyance path is used to sequentially discharge said recording medium so that said recording medium may be overlapped with a recording face thereof facing downward.

6. The recording apparatus as claimed in claim 2, wherein said overlap/supply mechanism comprises:

a pressure application member provided so as to be movable both in a direction of supplying a recording medium and in a direction of laminating medium, with respect to a rear end of recording medium overlapped in a hold means;

supply/driving means for moving said pressure application member in said direction of supplying a recording medium; and pressure-application-position adjustment means for moving said pressure application means in said laminating direction;

wherein after an opposing position with respect to a rear end of a recording medium is adjusted by said pressure-application-position adjustment means, said supply/driving means is driven to permit a pressure application means to reciprocate in order to pressure a rear end of a plurality of recording media that oppose said pressure application member of recording media overlapped in a hold means, thus pushing out said plurality of recording media to said conveyance path.

7. The recording apparatus as claimed in claim 3, wherein said overlap/supply mechanism comprises:

a pressure application member provided so as to be movable both in a direction of supplying a recording medium and in a direction of laminating a recording medium, with respect to a rear end of recording medium overlapped in a hold means;

supply/driving means for moving said pressure application member in said direction of supplying a recording medium; and pressure-application-position adjustment means for moving said pressure application means in said laminating direction;

wherein after an opposing position with respect to a rear end of a recording medium is adjusted by said pressure-application-position adjustment means, said supply/driving means is driven to permit a pressure application means to reciprocate in order to pressure a rear end of a plurality of recording media that oppose said pressure application member of recording media overlapped in a hold means, thus pushing out said plurality of recording media to said conveyance path.

8. The recording apparatus as claimed in claim 2, wherein said single-sheet supply mechanism comprises: a supply roller separably provided to a recording medium placed at an outermost position of recording media overlapped in a hold means and supply-roller driving means for rotationally driving said supply roller; and by rotating said supply roller by use of said supply-roller driving means, a recording medium at an outermost place in contact with said supply roller is supplied and, when an overlap/supply mechanism is driven, and held in such a state as not to be prevented from moving in a direction of supplying said recording medium.

9. The recording apparatus as claimed in claim 8, wherein said supply roller comprises on a peripheral surface thereof: a contact section which comes in contact with a recording medium; and a non-contact section which is separated from said recording medium, so that when an overlap/supply mechanism is driven, supply-roller-driving means stops rotation of a supply roller at such a phase that said non-contact section of said supply roller may oppose a recording medium.

10. The recording apparatus as claimed in claim 8, wherein said hold means is box-shaped, to an inner surface of which is fixed a separating member with a high friction coefficient to be contacted with a front end of a recording medium in a supply-direction.

11. The recording apparatus as claimed in claim 1, wherein said conveyance means is comprised of: a conveyance roller arranged in a conveyance path, and conveyance-roller driving means for rotationally driving said conveyance roller; and said conveyance-roller driving means rotates said conveyance roller by conveying to a recording position by a recording section a recording medium supplied by said recording-medium supply mechanism to a conveyance path, and in synchronization with movement in a main scanning direction by a recording section, conveys said recording medium in a sub-scanning direction which intersects with said main scanning direction.

12. The recording apparatus as claimed in claim 1, wherein said recording section generates a bubble to ink by means of thermal energy to discharge ink by means of pressure of said bubble.

* * * * *